US009018924B2

(12) United States Patent
Vemula

(10) Patent No.: US 9,018,924 B2
(45) Date of Patent: Apr. 28, 2015

(54) LOW DROPOUT REGULATOR

(75) Inventor: Madan Mohan Reddy Vemula, Tempe, AZ (US)

(73) Assignee: NXP B.V., Eindhoven (NL)

( * ) Notice: Subject to any disclaimer, the term of this patent is extended or adjusted under 35 U.S.C. 154(b) by 153 days.

(21) Appl. No.: 13/620,056

(22) Filed: Sep. 14, 2012

(65) Prior Publication Data

US 2014/0077777 A1 Mar. 20, 2014

(51) Int. Cl.
*G05F 1/00* (2006.01)
*G05F 1/56* (2006.01)

(52) U.S. Cl.
CPC ..... *G05F 1/56* (2013.01)

(58) Field of Classification Search
CPC ..... H02M 3/156; H02M 3/1584; H02M 2001/007; H02M 2001/0045; H02M 2001/0032; G05F 1/563; Y02B 70/16; Y02B 70/1466
USPC ..... 323/266, 268, 270, 273–276, 281; 363/59, 60; 361/18; 327/536
See application file for complete search history.

(56) References Cited

U.S. PATENT DOCUMENTS

| | | | | |
|---|---|---|---|---|
| 5,148,099 | A | 9/1992 | Ong | |
| 6,275,395 | B1 * | 8/2001 | Inn et al. | 363/60 |
| 6,998,830 | B1 | 2/2006 | Henry et al. | |
| 7,053,592 | B2 * | 5/2006 | Pihet et al. | 323/266 |
| 7,071,664 | B1 * | 7/2006 | Teggatz et al. | 323/280 |
| 7,365,523 | B2 * | 4/2008 | Malherbe et al. | 323/268 |
| 7,821,328 | B2 * | 10/2010 | Hoque et al. | 327/536 |
| 8,115,461 | B2 * | 2/2012 | Yoshio | 323/266 |
| 8,884,594 | B2 | 11/2014 | Sugiura | |
| 2004/0004469 | A1 | 1/2004 | Pihet et al. | |
| 2006/0132108 | A1 | 6/2006 | Teggatz et al. | |
| 2006/0176033 | A1 | 8/2006 | Malherbe et al. | |
| 2007/0290660 | A1 | 12/2007 | Yamazaki | |
| 2008/0136384 | A1 | 6/2008 | Al-Shyoukh et al. | |
| 2011/0089916 | A1 | 4/2011 | Soenen et al. | |
| 2012/0086777 | A1 * | 4/2012 | Chen et al. | 348/46 |

FOREIGN PATENT DOCUMENTS

CN 102645945 A 8/2012

OTHER PUBLICATIONS

Hilbiber, D.F., "A new semiconductor voltage standard," 1964 International Solid-State Circuits Conference: Digest of Technical Papers 2: 32-33 (1964).

* cited by examiner

*Primary Examiner* — Matthew Nguyen
*Assistant Examiner* — Kevin H Sprenger

(57) ABSTRACT

Aspects are directed to low dropout regulation. In accordance with one or more embodiments, an apparatus includes a charge pump that generates an output using a reference voltage, a low dropout (LDO) regulator circuit, current-limit and a voltage-limit circuit. The LDO circuit includes an amplifier powered by the charge pump and that provides an LDO voltage output. The voltage-limit circuit includes a transistor coupled between a voltage supply line and the LDO regulator circuit and a gate driven by the charge pump. The voltage-limit circuit limits voltage coupled between the voltage supply line and the LDO regulator circuit based upon the output of the charge pump, such as by coupling the voltage at the voltage supply line via source/drain connection of the transistor under low-voltage conditions, and providing a limited voltage to the LDO regulator circuit under high voltage conditions on the voltage supply line.

20 Claims, 5 Drawing Sheets

LOW DROPOUT REGULATOR

Many circuits benefit from and/or otherwise implement power supplies of varying characteristics, and have power requirements that may be limited in nature. For instance, many portable devices, sensitive electronics and others are desirably provided with power supply at a particular voltage level.

Providing certain limited voltage to certain circuits can be challenging, such as when other circuits in a common device may implement higher than desirable power, or when a power supply is susceptible to undesirable characteristics. For example, supply voltage emanating from wall (AC) plug or vehicle power outlet is susceptible to fluctuation, and can be noisy and unclean. This can result in ringing when a battery is charged from the same input supply. In addition, high voltage conditions can result from the use of faulty chargers, or from overshoot and undershoot at an LDO supply voltage that is used for a battery charger. In other applications, normal power provided within a device is simply too high for certain circuits therein.

In some applications, the power supply is current limited for a certain period of time, which can restrict circuitry from drawing power from the current limited power supply source. Drawing more current leads to a voltage drop on power supply that can lead to power supply shut down in various power supply interfaces, such as the USB On-The-Go device interface, which shut down the power supply to a peripheral (and stop the communication with the peripheral) if the peripheral draws a current that is larger than a current threshold set for the peripheral.

These and other matters have presented challenges to the presentation of desirable power level and quality, for a variety of applications.

Various example embodiments are directed to power supply and regulation-type circuits and their implementation.

According to an example embodiment, an apparatus includes a reference voltage supply circuit that supplies a reference voltage using a voltage supply line subject to fluctuations, a charge pump that generates an output using the reference voltage, a low dropout (LDO) regulator circuit and a voltage-limit circuit. The LDO circuit includes an amplifier that is powered by the charge pump output and that provides an LDO voltage output using a voltage on the voltage supply line. The voltage-limit circuit includes a transistor coupled between the voltage supply line and the LDO regulator circuit via a current limit circuit, and having a gate driven by the charge pump. The voltage-limit circuit operates to limit voltage coupled between the voltage supply line and each of the current limit circuit and the LDO regulator circuit, based upon the output of the charge pump. The voltage limit circuit limits the external power supply voltage line to a reasonable voltage driven by a minimum charge pump output or external power supply voltage line, and can be implemented to mitigate or prevent gate oxide stress for the current limit and the LDO circuitry that receive power from the external power supply line voltage.

Another example embodiment is directed to an apparatus having a charge pump coupled to generate an output voltage using a received reference voltage, and coupled to provide the output to the gate of a transistor having a source, drain and the gate. A capacitor is coupled between the charge pump output and ground (or reference voltage level), and also to the gate. The capacitor thus limits gate voltage increases responsive to transient steps in the voltage level of an external power supply line voltage and ensures that charge pump output is not coupled with respect to these transients. A current-limit circuit is coupled to the source of the transistor, with the transistor drain being connected to a voltage supply line and operative to couple voltage to the source in response to the voltage output of the charge pump. The current limit circuit ensures that current drawn from the external power supply line voltage does not exceed a certain limit, (e.g., set via characteristics of the current limit switch, and tailored to a particular application) which causes the external voltage line to drop. The apparatus also includes an amplifier coupled to and powered by the output voltage of the charge pump, and another NMOS transistor having its gate coupled to the output of the amplifier and its drain and source coupled between the current-limit circuit and a ground circuit respectively The above discussion/summary is not intended to describe each embodiment or every implementation of the present disclosure. The figures and detailed description that follow also exemplify various embodiments.

Various example embodiments may be more completely understood in consideration of the following detailed description in connection with the accompanying drawings, in which.

Figure 1:
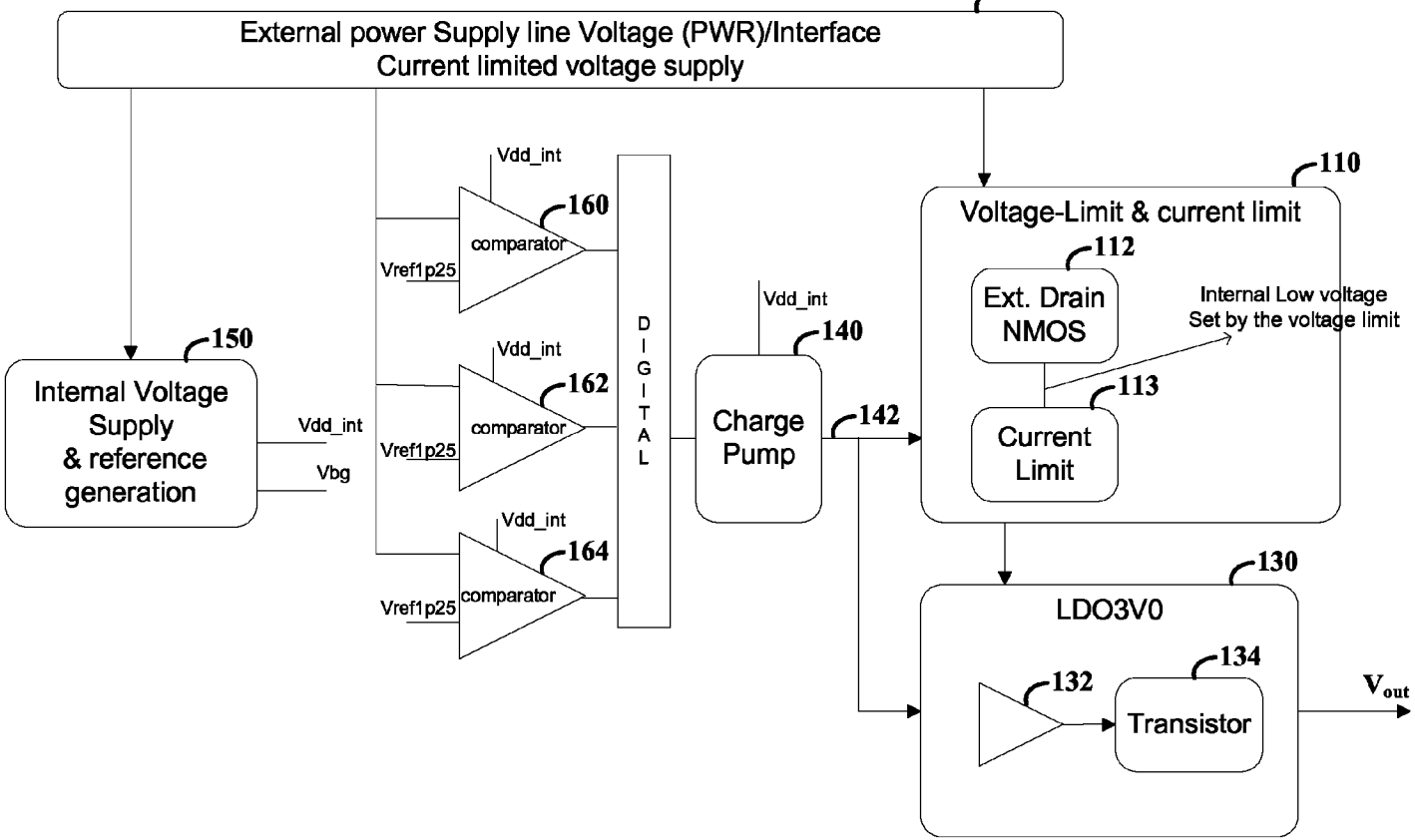
FIG. 1 shows a low dropout regulator (LDO) circuit, according to an example embodiment of the present invention.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

Aspects of the present disclosure are believed to be applicable to a variety of different types of apparatuses, systems and methods involving one or more of overcurrent or overvoltage type protection circuits, current limited power supply voltages, and current limit power interface circuits. While not necessarily so limited, various aspects may be appreciated through a discussion of examples using this context.

Various example embodiments are directed to an NMOS low drop out (LDO) regulator circuit that can sustain high input supply voltages and/or a wide LDO input range, utilizing an extended drain device. Higher (e.g., 25V) supply voltages are managed using a charge pump supply such that the higher supply voltage line is not coupled to internal nodes, with back bias protection (e.g., LDO output current is not coupled to the input supply voltage under related conditions, such as when the LDO output is 3V and the input power supply voltage line is 0V). This approach facilitates an extended drain switch that operates in a low ohmic state at low supply voltage, and in a high ohmic state or voltage limit as a source follower at higher power supply voltage (e.g., as may be applicable devices that can tolerate high gate-drain voltages, but not high gate-source voltages). The extended drain exhibits a low ohmic voltage drop, and does not significantly contribute to the LDO drop out voltage when power supply voltage line is low or close to the LDO output voltage.

In a more particular embodiment, a charge pump output of about 5.5V is provided to the gate of the of a high voltage extended drain NMOS transistor, which has high gate-drain breakdown voltage and higher drain substrate breakdown voltage, but low gate-source breakdown voltage. Extended drain NMOS transistor is used to limit the internal supply to an LDO to less than about 5.5V. When the power supply is higher, the drain of the extended NMOS transistor acts as a current source, limiting the amount of current and voltage limiting the source or internal supply to the gate voltage which is coupled to the charge pump output voltage. At low power supply voltage (e.g., for external power supply voltage levels less than the output voltage of the charge pump voltage minus the threshold of the extended drain NMOS transistor)) the drain of the extended NMOS transistor acts as a resistor (e.g., a switch) and causes a low voltage drop from LDO supply voltage to the output.

Various embodiments are directed to an LDO regulator circuit implemented for receiving an LDO supply voltage from a USB cable, such as for a wall (AC) plug or automobile charger, a docking station, and/or portable devices such as laptops and tablets. In such applications, the supply voltage is susceptible to fluctuation, and can be noisy and unclean, especially using long USB cables, as discussed in the background above. These issues can result in ringing when a battery is charged from the same input supply, during hot plug event in which USB port is connected, or during the faulty operating conditions in which the LDO needs to protect the internal circuitry from high voltage on a power supply line. Accordingly, such embodiments address these issues, as well as those relating to high supply voltages as may involve a faulty charger or when an LDO supply voltage is used to charge a host battery charger and causes overshoot and undershoot at the LDO supply voltage.

Regulator circuits such as LDO-type regulators discussed herein may be implemented in accordance with one or more of a variety of example embodiments. In accordance with a more particular embodiment, such an apparatus includes a reference voltage supply circuit, such as a bandgap supply circuit, that supplies a reference voltage using a voltage supplied via an external power supply line subject to fluctuations in voltage. A charge pump generates an output using the reference voltage, and provides the output to a low dropout (LDO) regulator circuit and to a voltage-limit circuit. The LDO circuit includes an amplifier that is powered by the charge pump and provides an LDO voltage output using a voltage coupled via the voltage-limit circuit. The voltage-limit circuit includes a transistor coupled between the external power supply voltage line and the LDO regulator circuit and having a gate driven by the charge pump. The voltage-limit circuit operates to limit voltage coupled between the external power supply voltage line and the LDO regulator circuit based upon the output of the charge pump, such as by coupling the voltage at the voltage supply line via source/drain connection of the transistor under external low-voltage supply conditions, and by providing a limited voltage to a voltage level corresponding to the charge pump output, less/minus a threshold voltage of the extended drain NMOS transistor to the LDO regulator circuit under high voltage conditions on the external voltage supply line (e.g., at or above a full/maximum operating voltage of the charge pump).

In some implementations, the voltage-limit circuit operates as a source follower and limits voltage provided to the LDO regulator circuit, responsive to a voltage on the voltage supply line in excess of a maximum operating output voltage of the charge pump (i.e., under normal operation of the LDO regulator circuit). The voltage-limit circuit further operates as a resistive switch to pass external supply voltage to the LDO regulator circuit, responsive to a voltage on the voltage supply line being less than the maximum operating output voltage of the charge pump.

Another example embodiment is directed to a low dropout (LDO) regulator circuit as follows. A charge pump generates an output voltage using a reference voltage and provides the output to drive a transistor having a source, drain and gate, the drain being connected to the external power supply voltage line and the gate being coupled to the voltage output of the charge pump. The transistor couples voltage to its source in response to the voltage output of the charge pump. A capacitor is coupled between the charge pump or gate and ground, and operates to limit gate voltage increases responsive to transient steps in the voltage level of the external supply voltage line. A current-limit circuit is coupled to the source of the transistor. An amplifier is coupled to and powered by the output voltage of the charge pump, and a transistor has a gate coupled to the output of the amplifier circuit and its source and drain coupled between the current-limit circuit and a ground circuit.

FIG. 1 shows a low dropout regulator (LDO) circuit 100, according to another example embodiment of the present invention. The circuit 100 includes a voltage-limit circuit 110 having an extended drain NMOS device 112 that limits voltage provided between a voltage supply line/interface 120 and current limit circuit 113 and the LDO circuitry 130, the voltage supply line being subject to high voltage conditions (e.g., above an operating voltage of the LDO circuitry). The gate of the NMOS device 112 is driven by a charge pump 140 at its output 142, which is also coupled to the LDO circuitry 130. The charge pump output 142 is fed by an internal voltage supply 150 that supplies a reference voltage. In some implementations, the reference voltage is provided to the charge pump 140 by way of a power-on-reset circuit including comparators 160, 162 and 164. The NMOS device 112 has a drain coupled to the voltage supply 120, and its source coupled to the current limit circuit to provide an internal voltage to the LDO circuitry 130. The LDO circuitry includes an amplifier 132 coupled to and powered by the charge pump, and which drives the gate of a transistor 134 coupled between the NMOS device 112 and ground, to control an output level of the LDO circuitry. In certain embodiments, the internal voltage is also fed to the amplifier 132.

In some implementations, the voltage-limit circuit 110 operates as a switch in a closed position to couple the voltage supply line 120 to the LDO regulator circuitry 130, when the voltage level of the voltage supply line is below an operating voltage of the charge pump 140 at which the charge pump outputs a maximum operating voltage level (e.g., where the line voltage level is below that voltage provided by the charge pump 140 under normal, full-power operation, the line voltage is coupled directly). When the voltage on the voltage supply line 120 is above the maximum operating voltage supplied by the charge pump 140, the voltage-limit circuit 110 operates as a source follower to limit voltage provided to the LDO regulator circuit 130 and current limit circuit 113 to a level corresponding to the voltage provided via the charge pump (e.g., less a threshold voltage of NMOS device 112 and other losses). In some implementations, the NMOS device 112 exhibits a limited gate-source voltage, which operates as the source follower or resistive switch accordingly.

In a more particular example embodiment, the reference voltage supply circuit includes a bandgap reference voltage circuit that provides the reference voltage as a bandgap reference voltage, using the external power supply voltage line and by shunting excess current in response to fluctuations on the external power supply voltage line to maintain the bandgap reference voltage supplied to the charge pump and comparators at about a constant level. In certain implementations, such a bandgap reference voltage supply circuit is implemented in accordance with one or more aspects described in U.S. patent application Ser. No. 13/618,444, entitled "Shunt Regulator," filed concurrently herewith and fully incorporated herein by reference.

Where implemented, the comparator circuit including comparators 160, 162 and 164 controls the LDO regulator circuit 130 in ON and OFF states based upon a voltage on the external power supply voltage being greater than a predetermined low threshold voltage (the predetermined voltage is defined by the minimum drop out voltage for the LDO) at which the LDO regulator circuit can operate. In some implementations, the comparators 160-164 control the LDO regulator as follows. The LDO regulator is controlled in a low-current mode in response to the voltage level on the LDO output being less than the threshold voltage. The LDO regulator circuit is controlled in a high-current mode in response to the LDO output voltage level being greater than the threshold voltage. These thresholds are measured looking at the power on reset on LDO output voltage. In some cases, the LDO regulator circuit is switched to an OFF state in response to the comparator output that monitors external power supply voltage line detecting that the voltage level is below the minimum voltage required for the LDO to generate an accurate output, and when external power supply voltage line is at a high voltage level. In some instances, this control is carried out by comparing the external power supply voltage level with a bandgap reference voltage. Current limit circuit 113 ensures that power drawn from the external power supply voltage line is always below the maximum power that it can deliver, as otherwise the external power supply voltage line can drop during power up conditions due to large capacitance or load transients on the LDO output, which can false trigger the comparator and lead to disabling the LDO.

Figure 2:
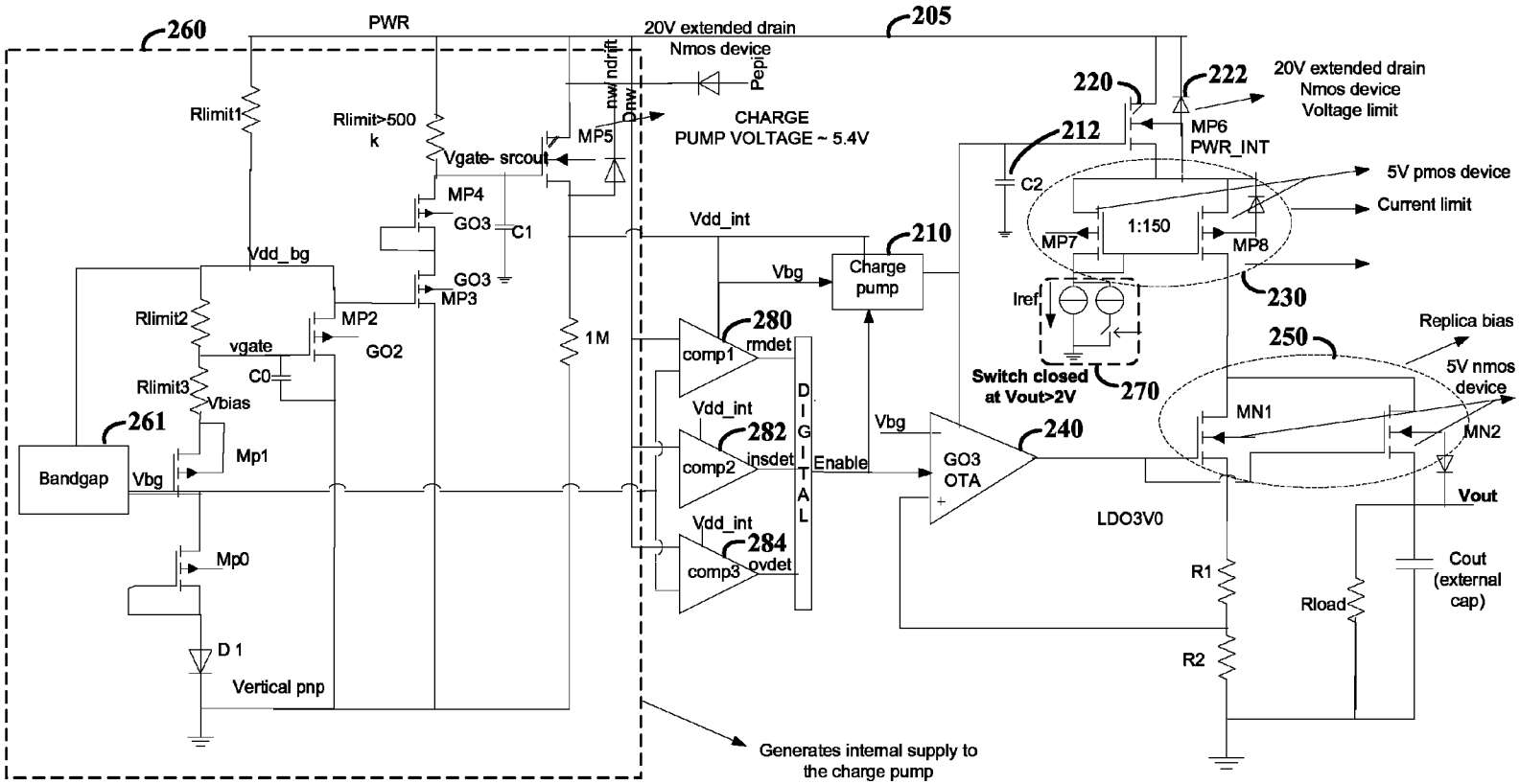
FIG. 2 shows another LDO circuit, according to another example embodiment of the present invention.

FIG. 2 shows another LDO circuit 200, according to another example embodiment of the present invention. The circuit 200 may, for example, be implemented using an approach similar to that discussed above in connection with FIG. 1. The circuit 200 is an NMOS-based LDO circuit with an extended drain device and low voltage devices, and is operable for use with high input supply voltage [PWR] (e.g., up to 25V) on a external power supply line voltage 205, and provides a limited voltage to LDO circuitry. A charge pump 210 provides an output that is coupled to an extended drain NMOS transistor 220 having a corresponding built-in diode 222, respectively coupled (in parallel) between the external power supply voltage line 205 and a current limit circuit 230. A capacitor 212 operates to maintain a voltage level on the gate of the transistor 220 (e.g., to address transient spikes), which acts as a source follower or a resistor based on the power supply voltage on 205.

The charge pump 210 also provides an output to an operational transconductance amplifier (OTA) 240 that provides a low dropout (LDO) voltage that is coupled to a replica bias circuit 250. A reference voltage circuit 260 provides a bandgap reference voltage for both the charge pump 210 and the OTA 240 (and therein the LDO) and comparators 280, 282 and 284. A current switch 270 operates to control the current provided at the replica bias circuit 250 at low and high current levels, respectively before and after ensuring proper operation of the circuit 200.

The charge pump 210, capacitor 212 and transistor 220 are implemented in a variety of manners to suit particular applications. In one such example, the transistor 220 is implemented to handle a maximum gate-source voltage of about 7V or less, and the charge pump 210 outputs a maximum operating voltage (e.g., irrespective of transient strikes) of about 5.4V to the gate of the transistor 220, which operates at a threshold voltage $V_{th}$. The transistor 220 operates as a resistor/switch if the power supply voltage is <5.4-$V_{th}$, and as a source follower if the power supply voltage >5.4V—$V_{th}$. At higher input supply voltages, the maximum voltage at the source of the transistor 220 (PWR_INT) is thus about 5.4-$V_{th}$, therein protecting all internal circuits tied to the supply voltage on 205. For instance, when the power supply is 25V, the charge pump 210 provides an output voltage that limits internal nodes to 5.4V minus $V_{th}$. The capacitor 212 limits gate voltage on the transistor 220 if there is a transient step on the power supply voltage, due to capacitive division.

When LDO operation is disabled, the charge pump 210 is disabled and the gate of the transistor 220 is pulled to 0V, under which conditions there is no high voltage coupled to the internal circuitry.

As discussed above, the reference voltage circuit 260 can be implemented using a variety of approaches. As shown in FIG. 2, an embodiment is directed to providing the reference voltage via a bandgap reference supply 261, which uses respective startup components MP1, MP0 and D1, a shunting transistor MP2, and cascaded PMOS transistors MP3 and MP4 that regulate the supply of the internal voltage supply vdd_int.

The current limit circuit 230 can be implemented in a variety of manners. As shown in FIG. 2, respective transistors (MP7/MP8) are coupled to the source of transistor 220, with transistor MP7 being coupled to the switch 270 and implemented therewith to carry out the current limiting functions. For general information regarding current limiting approaches, and for specific information regarding current limit circuits that may be implemented in connection with one or more example embodiments, and regarding various applications and implementations to which aspects of the present invention may be directed, reference may be made to U.S. patent application Ser. No. 13/485419, filed on May 31, 2012 and fully incorporated herein by reference.

Figure 3:
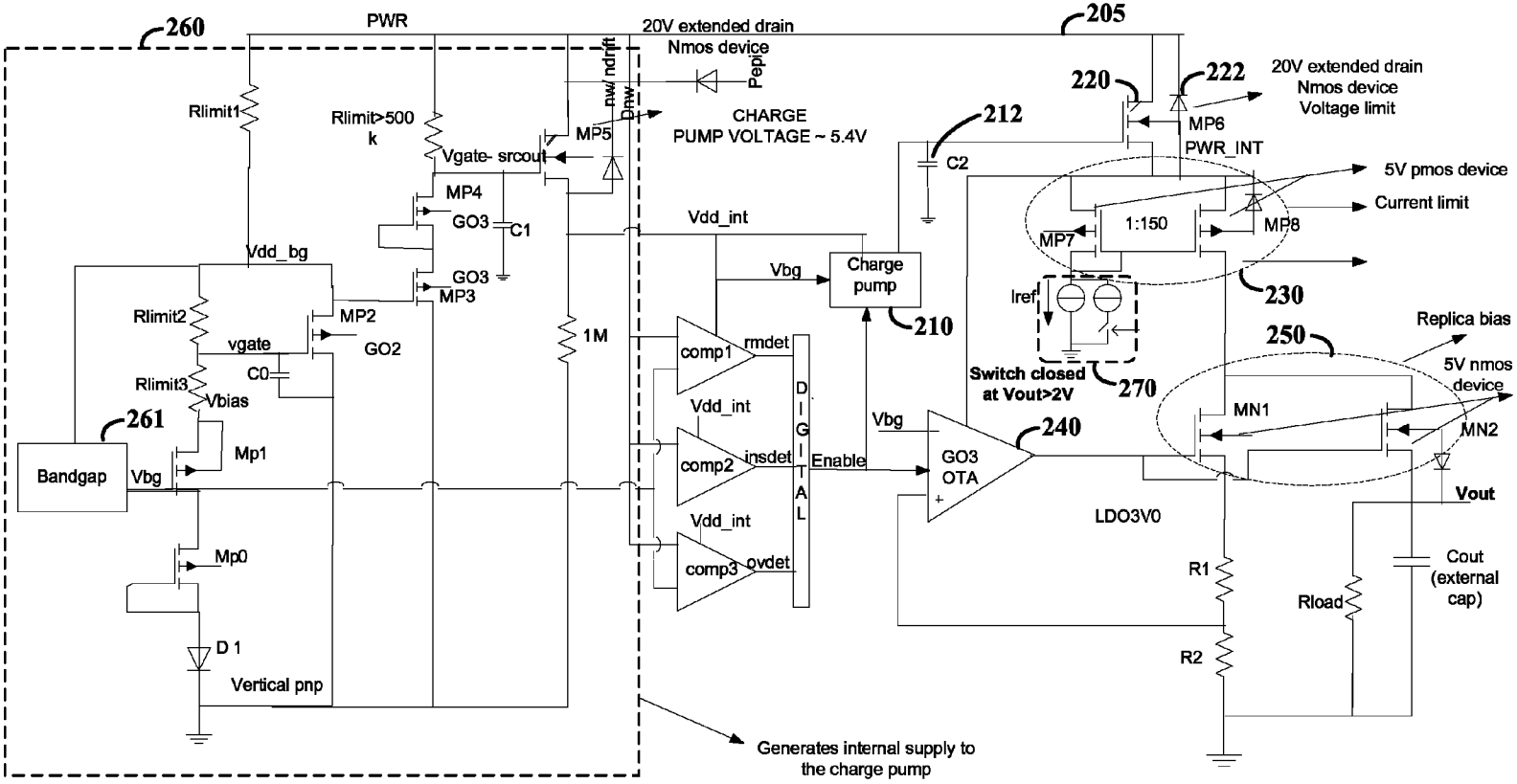
FIG. 3 shows another LDO circuit, according to another example embodiment of the present invention.

FIG. 3 shows another LDO circuit 300, in accordance with another example embodiment. The circuit 300 is similar to that shown in FIG. 2, with similar components being labeled with similar reference numbers. In FIG. 3, the OTA 240 is powered via the source of transistor 220 (at current limit circuit 230). Other aspects of FIG. 3 may be implemented as discussed above with FIG. 2.

Figure 4:
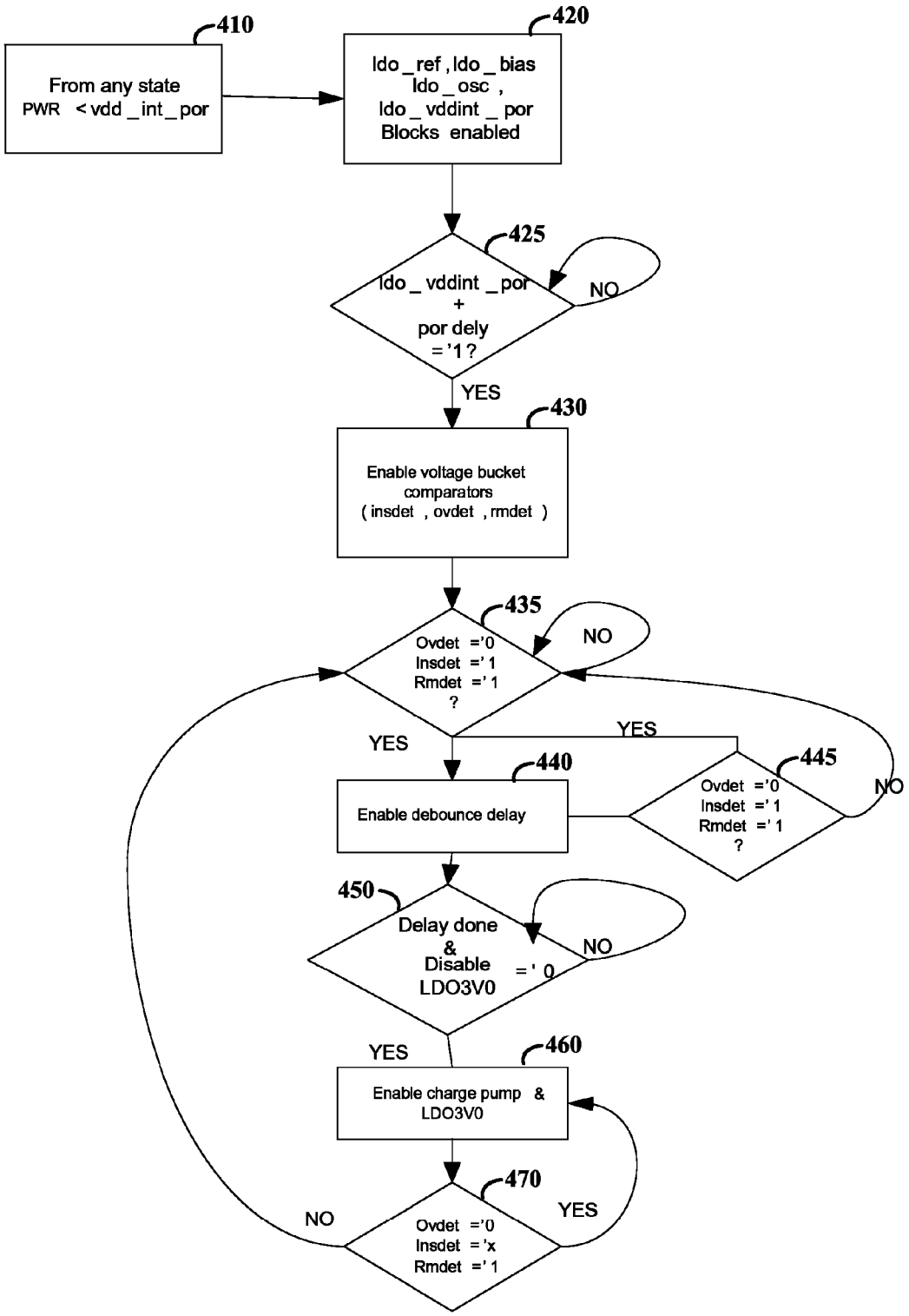
FIG. 4 shows a flow diagram for operation of a LDO circuit, according to another example embodiment of the present invention.

FIG. 4 shows a flow diagram for operation of a LDO circuit, according to another example embodiment of the present invention. Operation begins at block 410 from a state at which input power (PWR) is less than an internal power-on-reset (vdd_int_por). At block 420, low dropout components reference (ldo_ref), bias (ldo_bias), oscillator (ldo_osc), and internal power-on-reset (vdd_int_por) are enabled.

The process holds at block 425 until vdd_int_por plus a power-on-delay value is equal to one "1," after which voltage bucket comparators (insdet, ovdet, rmdet) are enabled at block 430. The comparators operate to determine a voltage level presented for the LDO circuit, such as described herein, to limit enabling of the LDO circuit until a sufficient voltage (rmdet) is present (and disabling the LDO below such a voltage). At block 435, if insdet=1, rmdet=1 and ovdet=0

(e.g., voltage is above rmdet and between insdet and ovdet), a debounce delay timer is enabled at block 440 which operates to provide a delay period (e.g., 10-17.5 ms) before operating on the condition of the respective comparator values (and therein account for abnormalities such as spikes). If during the debounce delay period, the aforesaid conditions (insdet=1, rmdet=1 and ovdet=0) fail at block 445, the process returns to block 435.

If the conditions hold during the debounce period, the process continues at block 450, holds while ldo_3v0_disable=0 is not true, and continues once ldo_3v0_disable=0 is true under which conditions the charge pump is enabled at block 460 with LDO3V0 being asserted.

Operation continues while insdet=x, rmdet=1 and ovdet=0 at block 470, or terminates and returns to block 435 if these conditions change. This block 435 ensures that even if the external power supply voltage is below the range during the power up of the LDO,LDO is still enabled during minor voltage dips on the power supply line.

Figure 5:
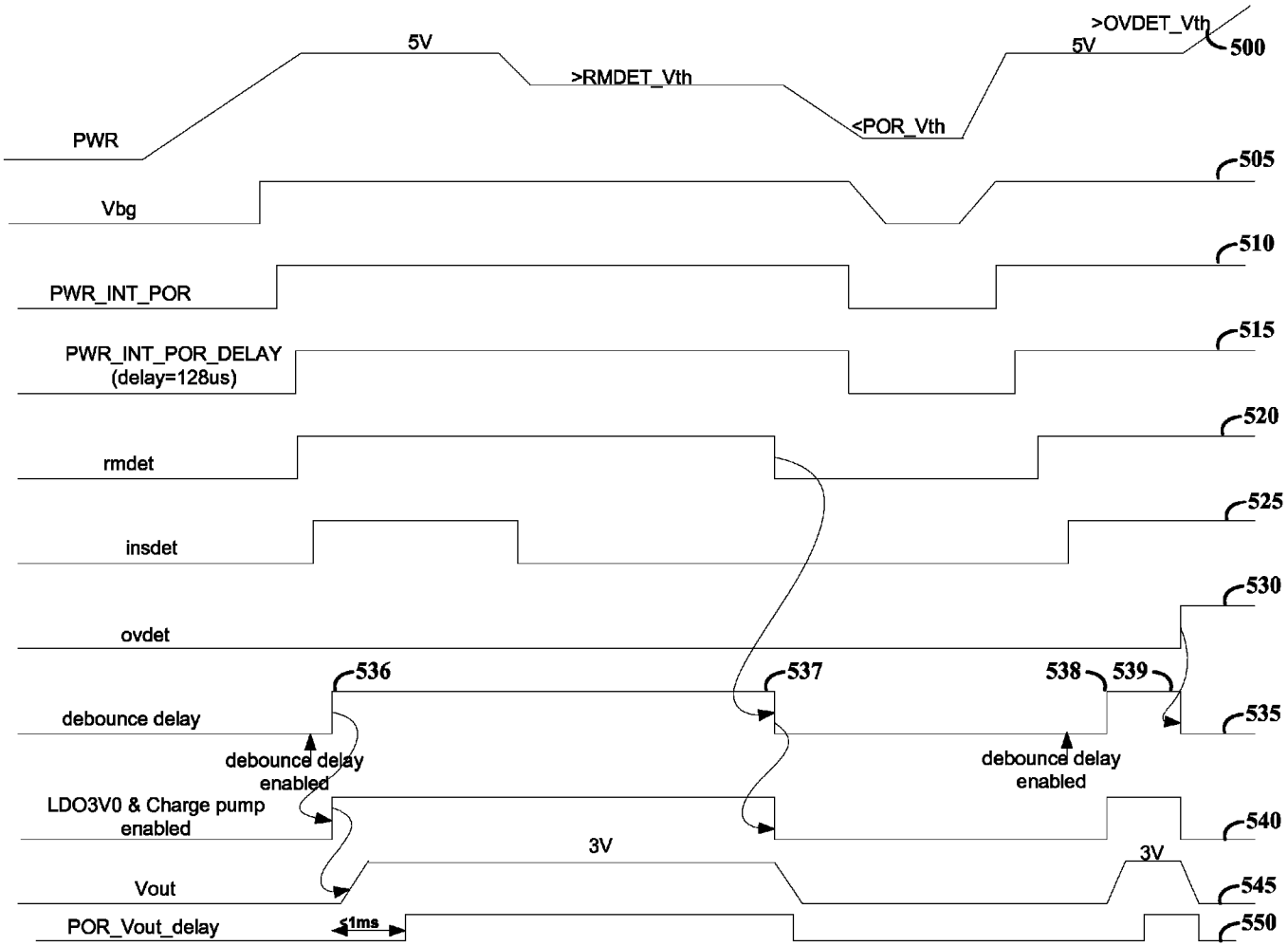
FIG. 5 shows a signal diagram for a LDO circuit, according to another example embodiment of the present invention.

FIG. 5 shows a signal diagram for a LDO circuit, according to another example embodiment of the present invention. The timing diagram shown in FIG. 5 may be implemented, for example, using the approach as shown in FIG. 4 and/or one or more circuits such as shown in FIGS. 1-3. By way of example, and relative to the discussion above with FIG. 4, the timing diagrams in FIG. 5 are shown operating with rmdet, insdet and ovdet thresholds respectively at 3.25V(RMDET_VTH), 4.25V(INSDET_VTH) and 6V(OVDET_VTH), such that operation is effected such that 4.25<PWR<6V.

Plot 500 shows input power PWR, and plot 505 shows reference voltage Vbg (e.g., from a bandgap reference). Plot 510 shows a power-on-reset ((PWR_INT_POR) value, and plot 515 shows a power-on-delay (PWR_INT_POR_DELAY) value. Plots 520, 525 and 530 respectively show comparator outputs (i.e., rmdet, insdet and ovdet values), and plot 535 shows a debounce delay value as may be implemented in accordance with the previous values in plots 520, 525 and 530 and as discussed above.

As shown in FIG. 5, the debounce delay 535 goes active at 536 after rmdet 520 and insdet 525 are high while ovdet is low, drops after rmdet goes low again at 537, asserts again at 538 after rmdet and insdet go high again, and drops again at 539 when ovdet goes high. Plot 540 is the enable value for the 3V LDO (LDO3V0 & charge pump) and follows the debounce delay plot 535, and plot 545 shows the LDO output bus voltage (vout) that follows plot 540 (with ramp up/down characteristics). Plot 550 shows a power-on-Reset delay for the bus (POR_vout_delay) that is implemented with a 1.17-1.29 ms delay (by way of example) relative to LDO output (Vout) in plot 545. The power-on-reset controls the lower and higher current limit mode for the LDO and power-on-Reset delay control signal provides additional delay before all the circuitry on the LDO output bus (Vout) is enabled. This ensures that the LDO output voltage is charged to its final value before any current is drawn from it.

The LDO-based circuits described herein can be implemented in a variety of different types of devices and applications. For instance, an LDO-based supply can be implemented with high-speed interfaces (e.g., via interface 120) such as USB powered devices, DisplayPort devices and HDMI devices, as well as peripheral devices, power and lighting applications, integrated circuit chip interfaces, data tags and readers, digital-to-analog and analog-to-digital converters, and video/display applications. For general information regarding such interfaces, and for specific information regarding the implementation of various embodiments in accordance with such interfaces, reference may be made to the USB 3.0 Specification and the On-The-Go and Embedded Host Supplement to the USB Revision 3.0 Specification Revision 1.1 available from the USB Implementers Forum, Inc.; to the DisplayPort version 1.2 specification available from the Video Electronics Standards Association; and to the HDMI Specification Version 1.4a, available from HDMI Licensing, Inc of Sunnyvale, Calif., all of which are fully incorporated herein by reference.

Based upon the above discussion and illustrations, those skilled in the art will readily recognize that various modifications and changes may be made to the various embodiments without strictly following the exemplary embodiments and applications illustrated and described herein. For example, a variety of internal supplies to the charge pump can be implemented to provide a low voltage bandgap supply. Different types of current limit circuits, and replica bias circuits, can be used in connection with an LDO circuit as discussed herein. Such modifications do not depart from the true spirit and scope of various aspects of the invention, including aspects set forth in the claims.

What is claimed is:

1. An apparatus comprising:

a reference voltage supply circuit configured and arranged to supply a reference voltage using a voltage supply line subject to fluctuations in voltage;

a charge pump coupled to receive the reference voltage from the reference voltage supply circuit and to generate an output voltage using the reference voltage;

a voltage-limit circuit including a transistor having a drain coupled to the voltage supply line and a gate connected to the output voltage of the charge pump, the voltage-limit circuit being configured and arranged to limit voltage coupled to its source based upon the output of the charge pump;

a first current limit circuit configured and arranged to limit current flowing from the voltage supply line, via the voltage-limit circuit, to a predefined current limit threshold; and a low dropout (LDO) regulator circuit including an amplifier coupled to and powered by an output voltage at an output of the charge pump, the LDO regulator circuit being configured and arranged to provide an LDO voltage output using a voltage provided via the source of the transistor in the voltage-limit circuit.

2. The apparatus of claim 1, further including a capacitor connected to a node coupled between the charge pump and the gate of the transistor, and configured and arranged to maintain a voltage level at the gate in response to a spike on the voltage supply line coupled to the gate.

3. The apparatus of claim 1, wherein the voltage-limit circuit is configured and arranged to limit voltage coupled between the voltage supply line and the LDO regulator circuit based upon the output of the charge pump by operating as a switch in a closed position to couple the voltage supply line to the LDO regulator circuit in response to a voltage on the voltage supply line being below an operating voltage of the charge pump at which the charge pump outputs a maximum operating voltage level, operating as a source follower to limit voltage provided to the LDO regulator circuit to a voltage provided via the charge pump, in response to a voltage on the voltage supply line that exceeds the maximum operating voltage level.

4. The apparatus of claim 1, wherein the voltage-limit circuit is configured and arranged to operate as a source follower and limit voltage provided to the LDO regulator circuit in response to a voltage on the voltage supply line in excess of a maximum operating output voltage of the charge pump, and operate as a resistive switch to pass voltage provided to the LDO regulator circuit in response to a voltage on the voltage supply line being less than the maximum operating output voltage of the charge pump.

5. The apparatus of claim 1, wherein the transistor is an extended drain NMOS transistor having a drain coupled to the voltage supply line and its source coupled to the LDO regulator circuit via the first current limit circuit, the transistor being configured and arranged to operate as a source follower and limit voltage provided to the LDO regulator circuit in response to a voltage on the voltage supply line in excess of a maximum operating output voltage of the charge pump, and operate as a resistive switch to pass voltage provided by the voltage supply line to the LDO regulator circuit in response to a voltage on the voltage supply line being less than a maximum operating output voltage of the charge pump.

6. The apparatus of claim 1, wherein the reference voltage supply circuit includes a bandgap reference voltage circuit configured and arranged to provide the reference voltage as a bandgap reference voltage using the voltage supply line and by shunting current in response to fluctuations on the voltage supply line to maintain the bandgap reference voltage supplied to the charge pump at about a constant level.

7. The apparatus of claim 1, wherein the transistor has an extended drain connected to the voltage supply line and a source connected to the LDO regulator circuit, and voltage-limit circuit is configured and arranged to operate as a resistive switch in response to a voltage on the voltage supply line that is less than the voltage output of the charge pump minus a threshold voltage of the transistor, and operate as a source follower in response to the voltage on the voltage supply line being greater than the value of a maximum operating voltage output of the charge pump minus the threshold voltage of the transistor, and thereby limit the voltage provided to the LDO regulator circuit to the value of the voltage output of the charge pump minus the threshold voltage of the transistor.

8. The apparatus of claim 1, wherein the transistor has a drain connected to the voltage supply line and a source connected to the LDO regulator circuit, and the transistor includes a built-in diode having its anode coupled to the source and a cathode coupled to the drain.

9. The apparatus of claim 1, further including a comparator circuit configured and arranged to switch the LDO regulator circuit between ON and OFF states based upon a voltage provided by the charge pump being greater than a predetermined low threshold voltage at which the LDO regulator circuit can operate.

10. The apparatus of claim 9, wherein the comparator circuit is configured and arranged to switch the LDO regulator circuit to the ON state by, in response to the voltage provided by the voltage supply line being greater than the predetermined low threshold voltage, starting a debounce delay timer and providing a signal to the charge pump and LDO regulator circuit to switch the LDO regulator circuit to an on state after a delay period based on the debounce delay timer.

11. The apparatus of claim 1, wherein the LDO regulator circuit includes a second transistor having a drain coupled to a voltage passed via the voltage and a plurality of current limit circuits including the first current limit circuit, a source coupled to a ground circuit via at least one resistor, and a gate coupled to the output of the amplifier.

12. The apparatus of claim 11, further including a second current limit circuit, of the plurality of current limit circuits, coupled between the voltage-limit circuit and the drain of the second transistor, and a replica bias circuit including a third transistor coupled in parallel with the second transistor between the second current limit circuit and the ground circuit.

13. The apparatus of claim 1, further including an external power supply interface coupled to the voltage supply line and configured and arranged to interface with at least one of: a universal serial bus (USB) based interface, a DisplayPort-based interface and a high-definition multimedia interface (HDMI).

14. An apparatus comprising:

an external power interface configured and arranged to interface with an external power source;

a low dropout (LDO) regulator;

a charge pump circuit configured and arranged to generate a voltage output;

a voltage-limit circuit including a transistor having a source, drain and gate, the drain being coupled to the external power interface, the gate being coupled to receive the charge pump voltage output, the voltage-limit circuit being configured and arranged to limit voltage coupled from the drain to the source, based upon the charge pump voltage output; and a current limit circuit configured and arranged to limit current flowing on a path, from the source to an output of the LDO regulator, to a transient current limit level lower than a predefined current limit threshold of the external power interface.

15. The circuit of claim 14, wherein the LDO regulator is configured and arranged to operate in a low current limit mode during a start-up period, and in a high current limit mode after the start-up period, to mitigate voltage drop on the external power interface.

16. The circuit of claim 15, wherein the voltage-limit circuit is configured and arranged to interrupt a current path between the external power interface and the LDO regulator in response to the LDO being in an off state.

17. The circuit of claim 14, where the LDO regulator is configured and arranged to operate in a low current mode and in a high current mode, further including a capacitor coupled to an output of the LDO regulator, and a power-on-reset delay circuit configured and arranged to delay switching the LDO circuit into the high current mode to facilitate charging of the capacitor.

18. An apparatus comprising:

a charge pump configured and arranged to generate an output voltage using a reference voltage and an external voltage provided via a voltage interface, a first transistor having a source, drain and gate, the drain being connected to an external voltage supply interface and the gate being coupled to the voltage output of the charge pump, the transistor being configured and arranged to couple voltage to the source in response to the voltage output of the charge pump, a capacitor coupled between an output of the charge pump and ground, the capacitor being configured and arranged to limit voltage increases on the gate in response to transient steps in the external voltage, a current-limit circuit coupled to source of the transistor and configured and arranged to limit current drawn from the external voltage supply interface, an amplifier circuit coupled to and powered by the output voltage of the charge pump, a replica bias circuit including second and third transistor circuits coupled in parallel between the current-limit circuit and a reference terminal and respectively having a transistor gate coupled to the output of the amplifier circuit, the third transistor circuit being configured and arranged to flow current at an order of magnitude higher than a current flowed via the second transistor circuit responsive to a common voltage drop across the respective second and third transistor circuits.

19. The apparatus of claim 18, wherein the first transistor is configured and arranged to couple voltage to the source in response to the voltage output of the charge pump by operating as a source follower and limiting voltage provided to the current-limit circuit in response to a voltage on the external voltage supply interface in excess of a maximum operating output voltage of the charge pump minus a threshold voltage of the transistor, and operate as a resistive switch to pass voltage provided by the external voltage supply interface to the current-limit circuit in response to a voltage on the external voltage supply interface being less than the maximum operating output voltage of the charge pump minus the threshold voltage of the transistor.

20. The apparatus of claim 18, wherein the capacitor is connected to a node that is in series between the charge pump and the gate of the first transistor; and the first transistor, charge pump and capacitor are configured and arranged to couple voltage from the external voltage supply interface from the drain to the source in response to the voltage on the external voltage supply interface being below a threshold voltage of an output of the charge pump, and to limit coupling of voltage between the source and drain in response to the voltage on the external voltage supply interface exceeding the threshold voltage.

* * * * *